US010985483B2

(12) United States Patent
Shioda et al.

(10) Patent No.: US 10,985,483 B2
(45) Date of Patent: Apr. 20, 2021

(54) ELECTRICAL CONNECTOR TO INCREASE CONNECTION RELIABILITY AND CONTROL THE IMPEDANCE OF THE TERMINALS

(71) Applicant: IRISO ELECTRONICS CO., LTD., Yokohama (JP)

(72) Inventors: Hideki Shioda, Yokohama (JP); Yoshihito Ohkuma, Yokohama (JP)

(73) Assignee: IRISO ELECTRONICS CO., LTD., Yokohama (JP)

( * ) Notice: Subject to any disclaimer, the term of this patent is extended or adjusted under 35 U.S.C. 154(b) by 0 days.

(21) Appl. No.: 16/817,396

(22) Filed: Mar. 12, 2020

(65) Prior Publication Data

US 2020/0295485 A1 Sep. 17, 2020

(30) Foreign Application Priority Data

Mar. 14, 2019 (JP) ..... JP2019-047236

(51) Int. Cl.
*H01R 12/73* (2011.01)
*H01R 12/71* (2011.01)
(Continued)

(52) U.S. Cl.
CPC ..... *H01R 12/73* (2013.01); *H01R 12/716* (2013.01); *H01R 12/722* (2013.01); *H01R 12/91* (2013.01);
(Continued)

(58) Field of Classification Search
CPC .... H01R 12/716; H01R 12/91; H01R 13/502; H01R 13/627; H01R 13/6315;
(Continued)

(56) References Cited

U.S. PATENT DOCUMENTS 6,439,931 B1 8/2002 Niitsu et al.
9,022,811 B2 5/2015 Takaki
(Continued)

FOREIGN PATENT DOCUMENTS

EP 2835874 A1 2/2015
JP H11-339921 A 12/1999
(Continued)

OTHER PUBLICATIONS

Extended European search report for European Patent Application No. 20163167.8 dated Jul. 21, 2020, 8 pages.

*Primary Examiner* — Abdullah A Riyami
*Assistant Examiner* — Justin M Kratt
(74) *Attorney, Agent, or Firm* — Westman, Champlin & Koehler, P.A.

(57) ABSTRACT

A connector includes: a first connector including a fitting portion and a first terminal provided in the fitting portion; and a second connector including a fitted portion configured to be fitted into the fitting portion of the first connector and a second terminal that is provided on the fitted portion, extends along a fitting direction, and comes into electrical contact with the first terminal in a case where the fitted portion is fitted into the fitting portion of the first connector, in which in the second terminal, a wide-width portion is formed in the second terminal, and the first terminal comes into contact with the wide-width portion of the second terminal from a state in which the fitted portion of the second connector is started to be fitted into the fitting portion of the first connector to a state in which the fitted portion cannot be fitted any further.

5 Claims, 12 Drawing Sheets

(51) Int. Cl.

| | |
|---|---|
| ***H01R 12/72*** | (2011.01) |
| ***H01R 12/91*** | (2011.01) |
| ***H01R 13/502*** | (2006.01) |
| ***H01R 13/627*** | (2006.01) |
| ***H01R 13/631*** | (2006.01) |
| ***H01R 13/6581*** | (2011.01) |
| *H01R 13/05* | (2006.01) |
| *H01R 13/6474* | (2011.01) |
| *H01R 13/26* | (2006.01) |
| *H01R 13/10* | (2006.01) |

(52) U.S. Cl.
CPC ..... *H01R 13/502* (2013.01); *H01R 13/627* (2013.01); *H01R 13/6315* (2013.01); *H01R 13/6581* (2013.01); *H01R 12/71* (2013.01); *H01R 13/05* (2013.01); *H01R 13/10* (2013.01); *H01R 13/26* (2013.01); *H01R 13/6474* (2013.01)

(58) Field of Classification Search
CPC ..... H01R 13/6581; H01R 13/26; H01R 13/6474; H01R 12/73; H01R 12/722; H01R 12/71; H01R 13/05; H01R 13/10
See application file for complete search history.

(56) References Cited

U.S. PATENT DOCUMENTS

| | | | | |
|---|---|---|---|---|
| 2002/0022407 | A1 | 2/2002 | Niitsu et al. | |
| 2010/0093232 | A1* | 4/2010 | Trout | H01R 13/41 439/875 |
| 2015/0044917 | A1 | 2/2015 | Takaki | |
| 2018/0019555 | A1* | 1/2018 | Shibuya | H01R 13/26 |
| 2018/0131145 | A1* | 5/2018 | Zhao | H01R 13/6474 |
| 2020/0119497 | A1* | 4/2020 | Chou | H01R 13/6471 |

FOREIGN PATENT DOCUMENTS

| | | | |
|---|---|---|---|
| JP | 2007-115707 | A | 5/2007 |
| JP | 2011-204483 | A | 10/2011 |
| JP | 2014-127422 | A | 7/2014 |

* cited by examiner

ELECTRICAL CONNECTOR TO INCREASE CONNECTION RELIABILITY AND CONTROL THE IMPEDANCE OF THE TERMINALS

CROSS-REFERENCE TO RELATED APPLICATION

This application claims priority under 35 USC 119 from Japanese Patent application No. 2019-047236 filed on Mar. 14, 2019, the disclosure of which is incorporated by reference herein in its entirety.

BACKGROUND

Technical Field

The present disclosure relates to a connector.

Related Art

Japanese Patent Application Laid-Open (JP-A) No. H11-339921 discloses a method and structure for tuning the impedance of terminals. The terminal is provided inside a connector and has a partially cut-out shape. Thereby, the capacitance of the terminal can be reduced and the impedance can be increased.

However, in the configuration disclosed in JP-A No. H11-339921, the terminal is partially cut out in a width direction of the terminal. Therefore, at the time of fitting into another connector, a contact area between the terminal and a terminal of a mating connector cannot be sufficiently ensured, or the terminal of the mating connector fits into a cut-out portion of the terminal, such that there is a possibility that an electrical conduction state cannot be ensured. Therefore, the technology according to JP-A No. H11-339921 has room for improvement in this respect.

SUMMARY

The present disclosure provides a connector that has an excellent reliability in connection with a mating terminal and can increase the impedance of terminals.

A first aspect of the present disclosure is a connector including: a first connector including a fitting portion and a first terminal provided in the fitting portion; and a second connector including a fitted portion configured to be fitted into the fitting portion of the first connector, and a second terminal that is provided on the fitted portion, extends along a fitting direction, and comes into electrical contact with the first terminal in a case in which the fitted portion is fitted into the fitting portion of the first connector, wherein: in the second terminal, a wide-width portion, having a dimension in one direction that is larger than a dimension of a general portion, is formed at a distal end side of the fitted portion, the one direction being an in-plane direction of a surface of the second terminal with which the first terminal comes into contact and being orthogonal to the fitting direction of the fitted portion, and the first terminal comes into contact with the wide-width portion of the second terminal from a state in which the fitted portion of the second connector starts to be fitted into the fitting portion of the first connector to a state in which the fitted portion is not able to be fitted any further.

According to the first aspect, the wide-width portion is formed in the second terminal provided on the fitted portion of the second connector. The wide-width portion is provided in the second terminal at the distal end side of the fitted portion of the second connector, and a dimension thereof in one direction (hereinafter, simply referred to as "width direction"), which is the in-plane direction of the surface of the second terminal with which the first terminal comes into contact and is orthogonal to the fitting direction of the fitted portion into the fitting portion of the first connector, is set to be larger than that of the general portion in the width direction. Further, the first terminal comes into contact with the wide-width portion of the second terminal from a state in which the fitted portion of the second connector is started to be fitted into the fitting portion of the first connector to a state in which the fitted portion cannot be fitted any further. Therefore, since the first terminal does not come into contact with the general portion of the second terminal, it is not necessary to consider a contact area between the general portion and the first terminal or the like for the dimension of the general portion in the width direction. For this reason, the dimension of the general portion in the width direction can be reduced in order to increase the impedance.

Further, since the first terminal comes into contact with the wide-width portion of which the dimension in the width direction is larger than that of the general portion in the second terminal in a state in which the fitted portion of the second connector cannot be fitted into the fitting portion of the first connector more, it becomes easy to secure a contact area. That is, an electrical conduction state can be ensured.

A second aspect of the present disclosure is the connector of the first aspect, in which on progression toward in the first terminal, an inclined guide portion is provided, which is inclined in a direction away from the second terminal on progression toward the second connector from a first terminal contact portion in the fitting direction, the first terminal contact portion being a portion with which the second terminal comes into contact, and in a state in which the fitted portion of the second connector is not able to be fitted into the fitting portion of the first connector any further, at least a portion of the inclined guide portion is disposed at a position corresponding to the general portion of the second terminal when viewed in a direction perpendicular to the surface of the second terminal with which the first terminal comes into contact.

According to the second aspect, the inclined guide portion is provided in the first terminal. The inclined guide portion can serve as a so-called guide to stably bring the first terminal contact portion into contact with the second terminal when the second connector is fitted into the first connector including the first terminal. Since the inclined guide portion is inclined in a direction away from the second terminal on progression toward the second connector from the first terminal contact portion in the fitting direction, the inclined guide portion does not come into contact with the second terminal in a state in which the first terminal contact portion is in contact with the second terminal. In other words, in a state in which the fitted portion of the second connector cannot be fitted into the fitting portion of the first connector any further, a portion of the second terminal that overlaps with at least a part of the inclined guide portion of the first terminal when viewed in a direction perpendicular to the surface of the second terminal with which the first terminal comes into contact is a dead space with which the first terminal does not come into contact. That is, since the general portion is disposed in the dead space, the impedance can be increased while effectively utilizing spaces.

A third aspect of the present disclosure is the connector of the first or second aspect, in which an inclined portion, which smoothly connects the wide-width portion and the general portion to each other when viewed in the direction perpendicular to the surface of the second terminal with which the first terminal comes into contact, is provided between the wide-width portion and the general portion in the second terminal.

According to the third aspect, the inclined portion is provided between the wide-width portion and the general portion in the second terminal, and the inclined portion smoothly connects the wide-width portion and the general portion to each other when viewed in the direction perpendicular to the surface of the second terminal with which the first terminal comes into contact. Therefore, it is possible to suppress the reflection of an electric signal from occurring at a boundary between the wide-width portion and the general portion.

A fourth aspect of the present disclosure is the connector of any one of the first to third aspects, in which the general portion of the second terminal has a substantially constant dimension in the one direction that is the in-plane direction of the surface of the second terminal with which the first terminal comes into contact and that is orthogonal to the fitting direction of the fitted portion.

According to the fourth aspect, since the dimension of the general portion in the width direction is substantially constant, it is possible to suppress the reflection of the electric signal as compared with a configuration in which a notch or the like is partially provided to increase the impedance.

A fifth aspect of the present disclosure is the connector of any one of the first to fourth aspects, in which the second terminal is formed by using a plate having a thickness direction in a direction perpendicular to the surface of the second terminal with which the first terminal comes into contact.

According to the fifth aspect, since the second terminal is formed by using a plate of which a thickness direction is the direction perpendicular to the surface of the second terminal with which the first terminal comes into contact, the wide-width portion and the general portion are configured such that dimensions of the plate in the width direction are different from each other. That is, since the plate is processed in the width direction to form the wide-width portion and the general portion, the dimensional accuracy can be improved as compared with a case in which the plate is processed in the thickness direction. Therefore, variation in shape of the second terminal can be reduced.

As described above, the connector according to the present disclosure has an excellent reliability in connection with a mating terminal, and can increase the impedance of terminals.

BRIEF DESCRIPTION OF THE DRAWINGS

Exemplary embodiments of the present disclosure will be described in detail based on the following figures, wherein.

and

Figure 6:
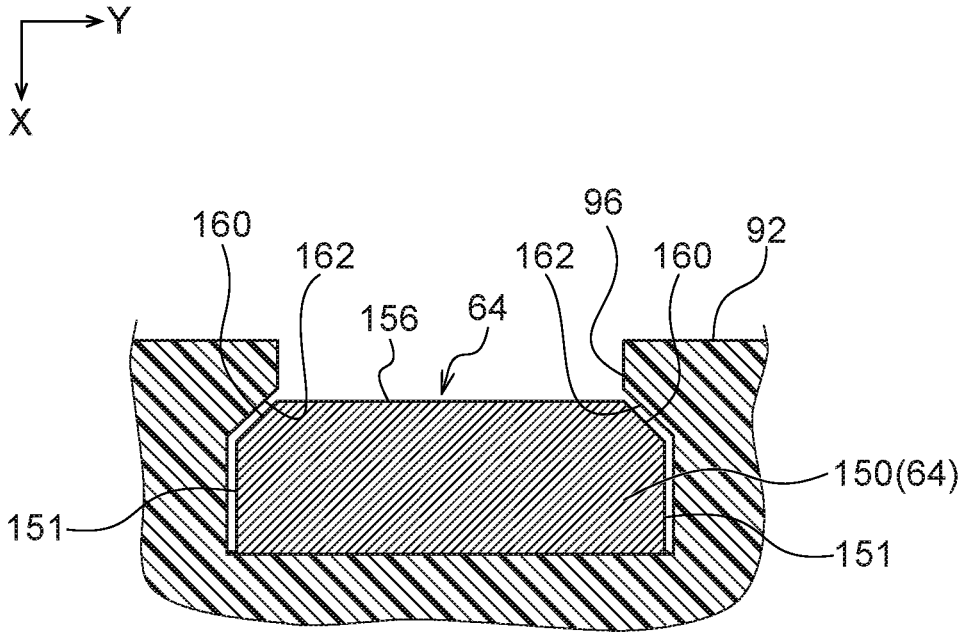
FIG. 6 is a cross-sectional view illustrating a state taken along line B-B in FIG. 5.
Figure 12:
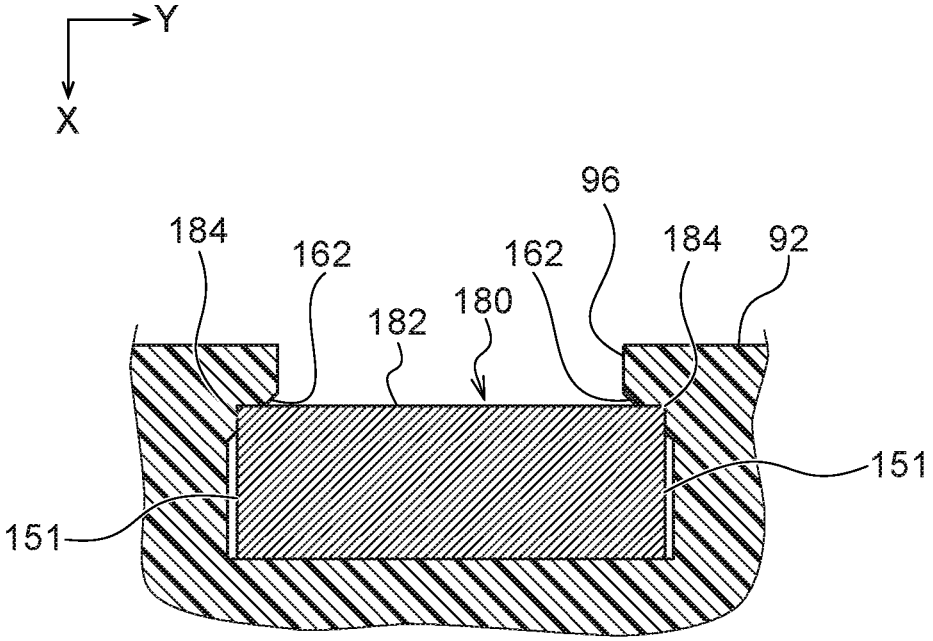

FIG. 12 is a cross-sectional view of the second terminal according to a modified example, corresponding to FIG. 6.

DETAILED DESCRIPTION

An embodiment of the present disclosure will be described with reference to FIGS. 1 to 10.

In the following description, an arrow X illustrated in each drawing indicates a front direction of a connector, an arrow Y indicates one side (right side) in a width direction of the connector, and an arrow Z indicates a top direction of the connector. Unless otherwise specified, terms such as front and rear, top and bottom, and width (left and right) are used to indicate front and rear sides in a connector front-rear direction, top and bottom sides in a connector top-bottom direction, and width (left and right sides) in a connector width direction (left-right direction). These directions are independent of a direction in a state in which the connector is being used. In the respective figures, some reference numerals may be omitted in order to facilitate understanding of the figures.

(Overall Configuration)

Figure 2:
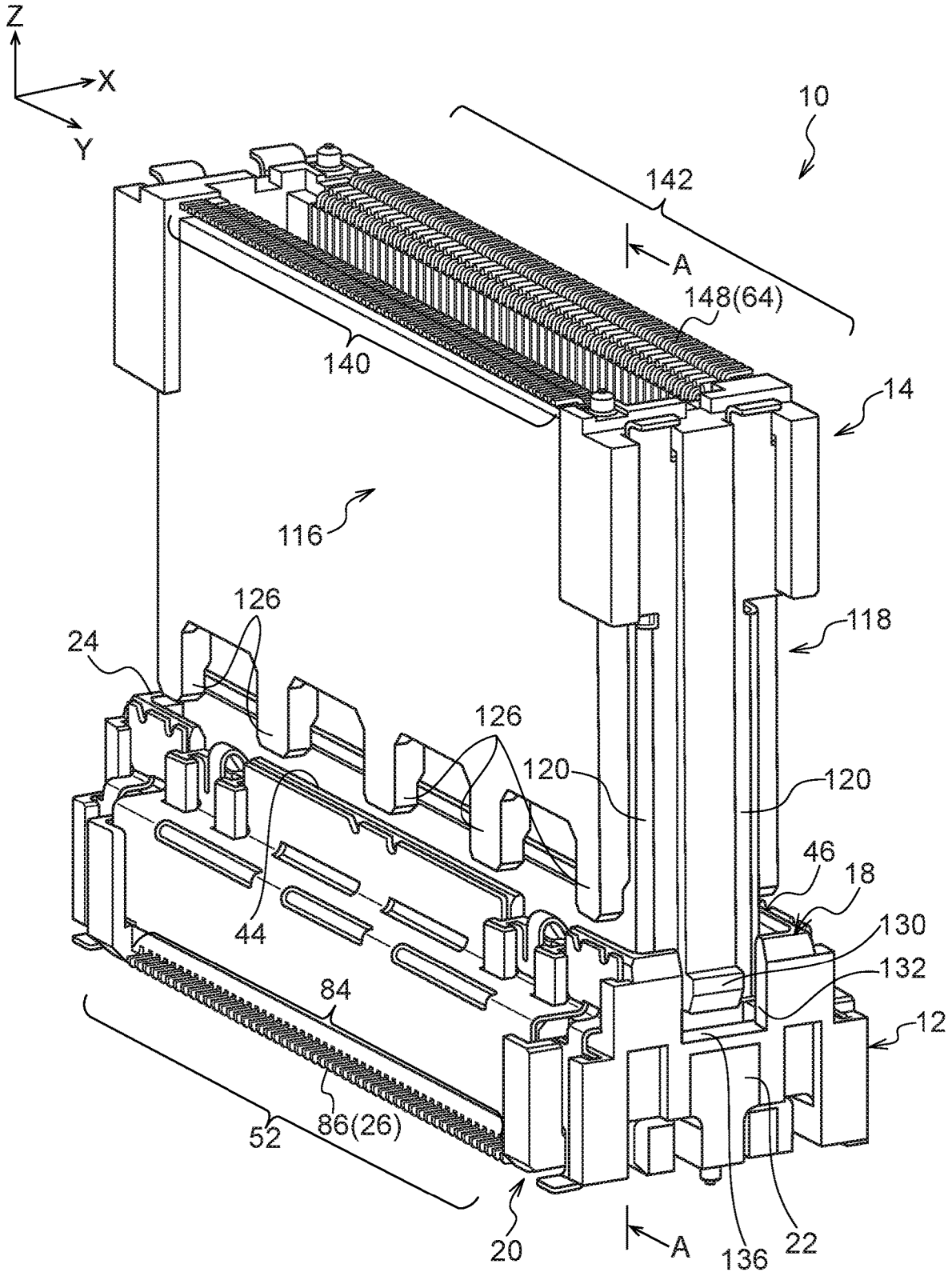
FIG. 2 is a perspective view illustrating a normal fitted state of a connector according to an embodiment.

As illustrated in FIG. 2, a connector 10 according to the present embodiment includes a first connector 12 and a second connector 14. The first connector 12 and the second connector 14 are fixed to different circuit boards, respectively. The second connector 14 can be fitted into the first connector 12 in a Z direction. In the embodiment, the fitting direction Z coincides with a top-bottom direction of the connector 10, and in the following description, the fitting direction Z may also be referred to as "top-bottom direction". The connector 10 is formed in a shape symmetrical in a front-rear direction and a left-right direction.

(First Connector)

The first connector 12 is a so-called movable (floating) connector, and includes a movable housing 18 into which the second connector 14 as a connection target is fitted, and a fixed housing 20 fixed to a circuit board (not illustrated). The fixed housing 20 has a pair of side wall portions 22 and 24 disposed on opposite sides in a terminal arrangement direction (a direction indicated by the arrow Y) orthogonal to the fitting direction (a direction indicated by the arrow Z) in which the second connector 14 is fitted into the movable housing 18.

Figure 4:
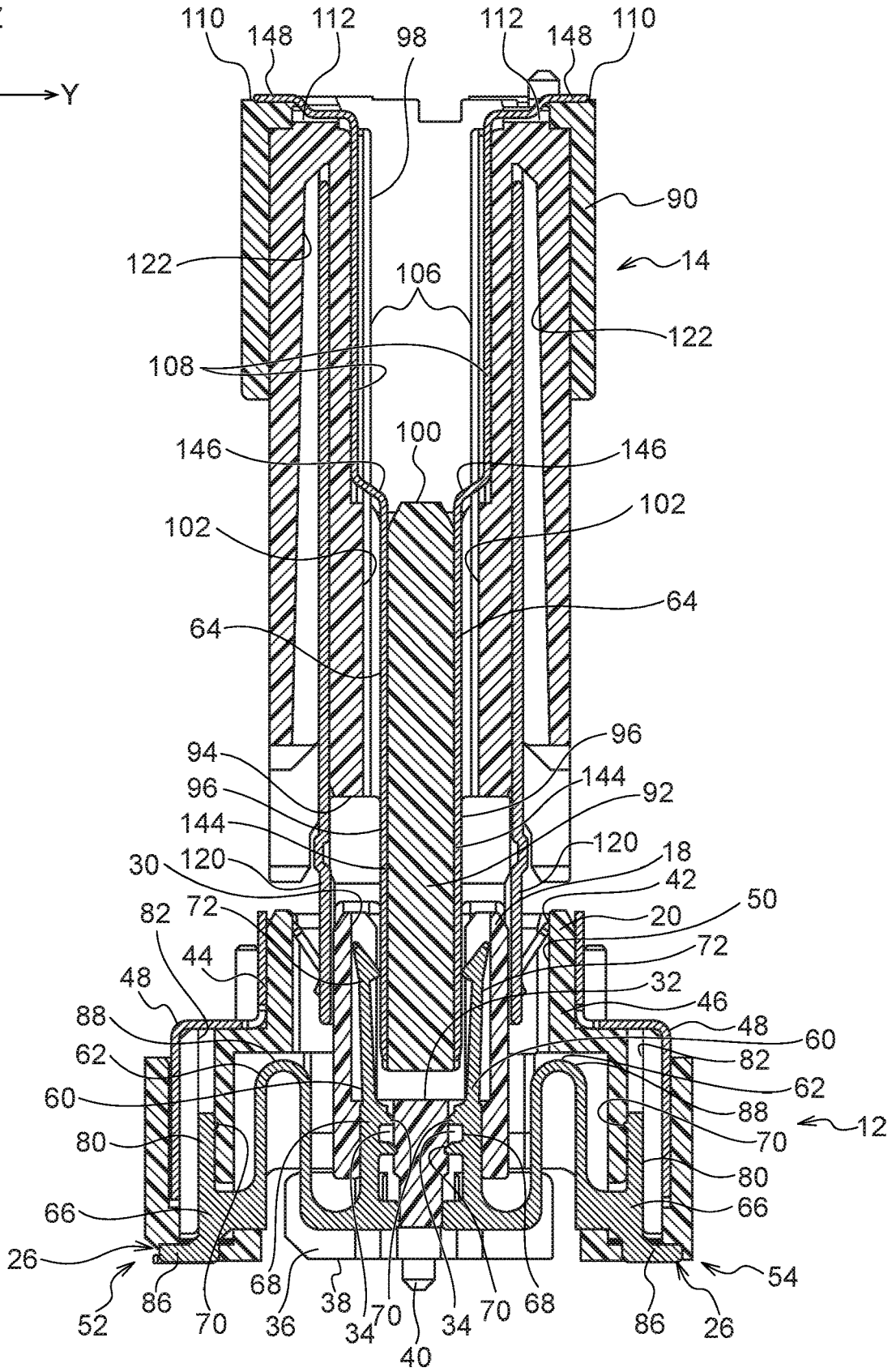
FIG. 4 is a cross-sectional view illustrating a state taken along line A-A in FIG. 2.

The first connector 12 includes a plurality of first terminals 26 bridging between the movable housing 18 and the pair of side wall portions 22 and 24 along a bridging direction (the direction indicated by the arrow X), and arranged in the fitting direction Z and the terminal arrangement direction Y (see FIG. 4).

As illustrated in FIG. 4, the movable housing 18 is formed in a substantially rectangular cylindrical shape (a substantially rectangular parallelepiped shape) with a bottom, which has a fitting portion 30 opened upward. The movable housing 18 is formed of, for example, an insulating material such as a synthetic resin. Although the movable housing 18 according to the embodiment is formed in an elongated shape with a long side in the left-right direction, the dimension of the movable housing 18 in the left-right direction is configured to be appropriately changed depending on the number of first terminals 26.

A plurality of first terminal insertion holes 34 extending in the top-bottom direction are formed, at equal intervals in the left-right direction, on a bottom wall 32 as a part of the fitting portion 30. These first terminal insertion holes 34 are open in the top-bottom direction. Further, lower end portions of the first terminal insertion holes 34 are provided above facing surfaces 38 of opposite protruding portions 36 (only one protruding portion 36 is illustrated in FIG. 4) provided in pair in the left-right direction of the movable housing 18, the facing surfaces 38 facing the circuit board.

The fixed housing 20 having a rectangular through-hole 42 that penetrates in the top-bottom direction and formed in a substantially rectangular frame shape is provided around the movable housing 18. The fixed housing 20 is formed of, for example, an insulating material such as a synthetic resin. Note that although the fixed housing 20 according to the embodiment is formed in an elongated shape of which a longitudinal direction is the left-right direction, the dimension of the fixed housing 20 in the left-right direction is configured to be appropriately changed depending on the number of first terminals 26. A shield shell 48 formed of metal is attached to each of a pair of side wall portions 44 and 46 in the front-rear direction of the fixed housing 20.

The movable housing 18 is disposed inside the through-hole 42 of the fixed housing 20. A gap 50 having a substantially rectangular annular shape when viewed in the top-bottom direction is formed between an inner peripheral surface of the through-hole 42 of the fixed housing 20 and an outer peripheral surface of the movable housing 18.

A pair of left and right positioning bosses 40 protruding downward is formed on the fixed housing 20. Each positioning boss 40 is fitted into a positioning hole (not illustrated) formed in the circuit board.

(First Terminal)

The plurality of first terminals 26 are formed by punching a conductive metal plate into a predetermined shape, and constitute a pair of front and rear terminal rows 52 and 54. The front and rear terminal rows 52 and 54 each have a configuration in which the plurality of first terminals 26 are arranged at equal intervals in the left-right direction. The plurality of first terminals 26 of the front terminal row 52 and the plurality of first terminals 26 of the rear terminal row 54 are formed in the same shape, and are disposed to face each other in the front-rear direction. The plurality of first terminals 26 of the front terminal row 52 bridge between the front side wall portion 44 of the fixed housing 20 and the movable housing 18 in the front-rear direction, and the plurality of first terminals 26 of the rear terminal row 54 bridge between the rear side wall portion 46 of the fixed housing 20 and the movable housing 18 in the front-rear direction.

Each first terminal 26 includes a first contacting portion 60, a first elastic portion 62, and a first connection portion 66. The first contacting portion 60 is held by the movable housing 18 and is in an electrical contact with a second terminal 64 described later provided in the second connector 14, while being elastically deformed outward in the front-rear direction. The first elastic portion 62 extends outward from the first contacting portion 60 in the front-rear direction and is elastically deformable. The first connection portion 66 extends outward from an end portion of the first elastic portion 62 in the front-rear direction, is held by the fixed housing 20, and is fixed to the circuit board, the end portion of the first elastic portion 62 being opposite to an end portion from which the first contacting portion 60 extends.

The first contacting portion 60 is formed in an elongated plate shape of which a plate thickness direction is the left-right direction, and a longitudinal direction is the top-bottom direction. The first contacting portion 60 is inserted from below into the first terminal insertion hole 34 of the movable housing 18. A substantially lower half portion of the first contacting portion 60 serves as a first holding portion 68 inserted (press-fitted) into the first terminal insertion hole 34 of the movable housing 18. A plurality of claw portions 70 projecting toward the center of the movable housing 18 in the front-rear direction are formed on the first holding portion 68 while being arranged in the top-bottom direction. The plurality of claws 70 bite into an inner peripheral surface of the first terminal insertion hole 34, such that the first holding portion 68 is held by the movable housing 18.

A substantially upper half portion of the first contacting portion 60 serves as a first terminal elastic portion 72 extending in the top-bottom direction. The first terminal elastic portion 72 is disposed in the fitting portion 30 of the movable housing 18, and is elastically deformable in the front-rear direction. A first terminal contact portion 74 (see FIG. 9) projecting toward an inner side of the fitting portion 30 of the movable housing 18 is formed on an upper end of the first terminal elastic portion 72. The first terminal contact portion 74 comes into contact with the second terminal 64 provided in the second connector 14. As a result, the first terminal 26 is electrically connected to the second terminal 64.

An inclined guide portion 76 is provided on an upper side of the first terminal contact portion 74 of the first terminal elastic portion 72. The inclined guide portion 76 has an inclined surface that is inclined outward in the front-rear direction as directing upward from the first terminal contact portion 74. In other words, the inclined guide portion 76 is inclined so as to be separated from the second terminal 64 on progression toward a distal end of the first terminal elastic portion 72 from the first terminal contact portion 74.

The first connection portion 66 includes a first press-fitted portion 80 and a first connection piece 86, and is formed in a substantial L-letter shape when viewed in the left-right direction. The first press-fitted portion 80 is inserted (press-fitted) from below into a first terminal insertion hole 82 formed in the fixed housing 20. The first connection piece 86 extends outward from a lower end of the first press-fitted portion 80 in the front-rear direction and is inserted into a groove portion 84 (see FIG. 2) of the first terminal insertion hole 82. The claw portion 70 projecting toward the center of the fixed housing 20 in the front-rear direction is formed on the first press-fitted portion 80. The first press-fitted portion 80 is held by the fixed housing 20 as the claw portion 70 is hooked on an inner peripheral surface of the first terminal insertion hole 82. The first connection piece 86 projects outward from the fixed housing 20 in the front-rear direction. The first connection piece 86 is fixed (electrically connected) to the circuit board by means such as soldering.

The first elastic portion 62 constitutes an intermediate portion of the first terminal 26 in the front-rear direction, and extends integrally from a lower end of the first contacting portion 60 outward in the front-rear direction. The first connection portion 66 extends integrally from an end portion of the first elastic portion 62 that is opposite to an end from which the first contacting portion 60 extends. The first elastic portion 62 serves as a first spring portion 88 of which an intermediate portion in the front-rear direction is bent so as to protrude upward (in a direction in which the second connector 14 is removed). The first spring portion 88 has an inverted U-letter shape of which a lower side is open when viewed in the left-right direction.

(Second Connector)

The second connector 14 is provided with a second housing 90 and a plurality of second terminals 64. The second housing 90 is formed in a substantially rectangular cylindrical shape (a substantially rectangular parallelepiped shape). The second housing 90 is formed of, for example, an insulating material such as a synthetic resin. Note that although the second housing 90 according to the embodiment is formed in an elongated shape of which a longitudinal direction is the left-right direction, the dimension of the second housing 90 in the left-right direction is configured to be appropriately changed depending on the number of second terminals 64.

Figure 1:
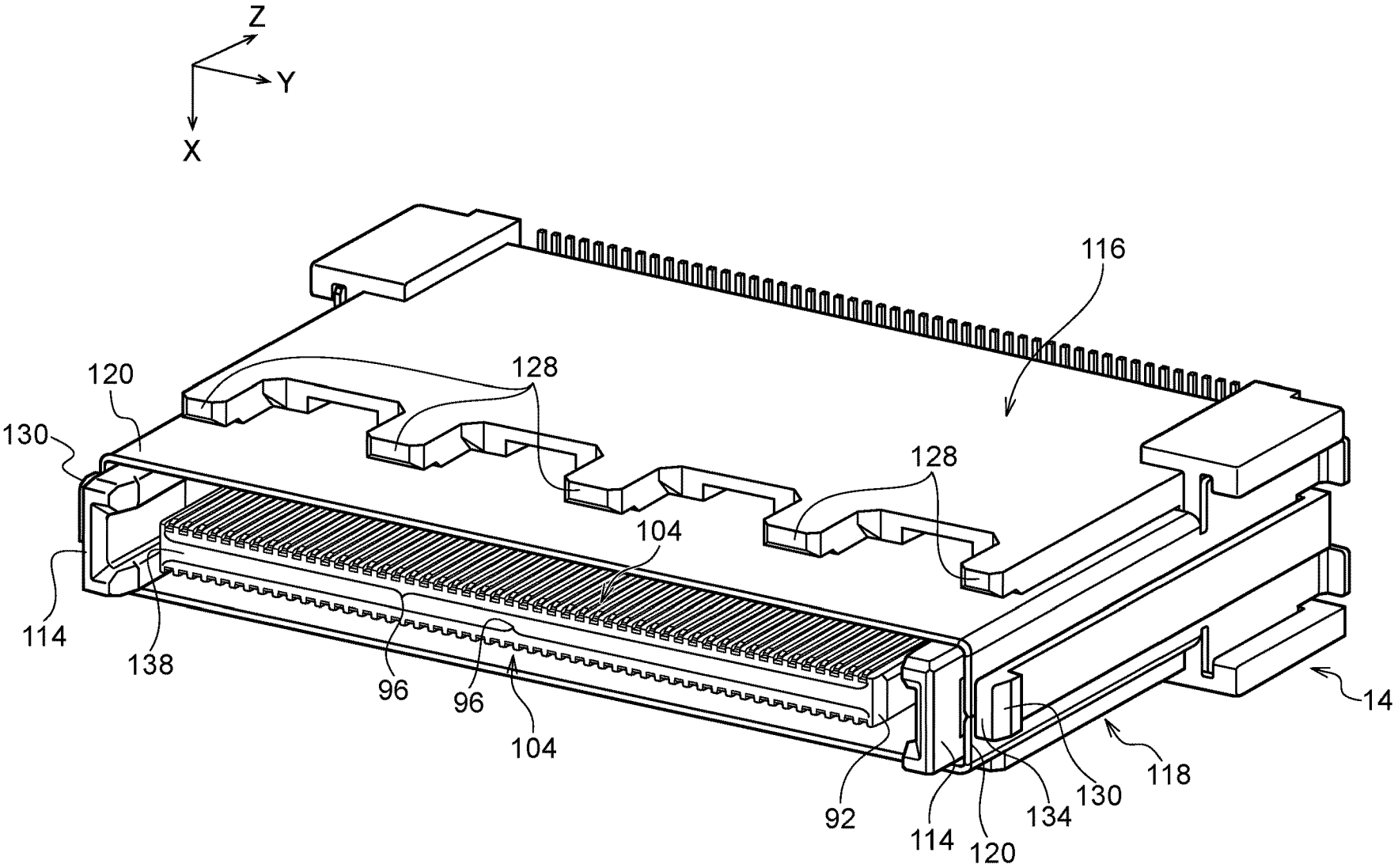
FIG. 1 is a perspective view of a second connector according to an embodiment.

A fitted portion 92 is provided at a lower portion of the second housing 90. The fitted portion 92 is provided substantially at the center of a bottom surface 94 of the second housing 90 in the front-rear direction and the left-right direction, and projects downward from the bottom surface 94. As illustrated in FIG. 1, the fitted portion 92 is formed in a substantially rectangular parallelepiped shape of which a longitudinal direction is the left-right direction, and a plurality of groove portions 96 are formed in each of a pair of side wall portions 104 in the front-rear direction while being arranged at equal intervals in the left-right direction. The groove portion 96 extends in the top-bottom direction and has a shape in which a cross section orthogonal to the longitudinal direction is open outward in the front-rear direction (see FIG. 6), and an upper end portion of the groove portion 96 is connected to second terminal insertion holes 102 (see FIG. 4) formed from the bottom surface 94 to a bottom wall 100 of a recess portion 98 provided at an upper side of the second housing 90. A plurality of groove portions 108 extending in the top-bottom direction are formed in each of a pair of side wall portions 106 of the recess portion 98 at positions corresponding to the second terminal insertion holes 102, while being arranged at equal intervals in the left-right direction. Further, groove portions 112 extending in the front-rear direction are formed in a pair of upper wall portions 110 of the recess portion 98 at positions corresponding to the groove portions 108, while being arranged at equal intervals in the left-right direction.

A pair of extending wall portions 114 is provided at outer sides of the fitted portion 92 in the left-right direction, respectively. The extending wall portions 114 project downward from outer end portions of the bottom surface 94 (see FIG. 4) of the second housing 90 in the left-right direction, respectively. The projecting amount of the extending wall portion 114 from the bottom surface 94 is larger than the projecting amount of the fitted portion 92 from the bottom surface 94.

A pair of shield shells 120 is each provided on each of side wall portions 116 and 118 of the second housing 90 in the front-rear direction. The shield shell 120 is formed by using a metal plate, and is inserted from below into a deep groove portion 122 (see FIG. 4) that is formed in each of the side wall portions 116 and 118 of the second housing 90 and is open downward. The shield shells 120 are formed to be symmetrical in the front-rear direction, and thus are formed in a substantially rectangular cylindrical shape in which the fitted portion 92 and the extending wall portion 114 are accommodated.

As illustrated in FIG. 2, a plurality of abutting portions 126 are formed at outer sides of the shield shells 120 on the side wall portions 116 and 118 in the front-rear direction. The abutting portions 126 are configured such that bottom wall portions 128 (see FIG. 1) face upper end portions of the side wall portions 44 and 46 of the fixed housing 20 of the first connector 12, respectively, in a state in which the second connector 14 is fitted into the first connector 12.

Further, abutting portions 130 are formed at outer sides of the shield shells 120 on the side wall portions 116 and 118 in the left-right direction, respectively. The abutting portions 130 are configured such that the abutting portions 130 are inserted from above into fitting grooves 132, respectively, the fitting grooves 132 being formed in pair at an outer side of the fixed housing 20 in the left-right direction and being open upward in a state in which the second connector 14 is fitted into the first connector 12, and a bottom wall portion 134 (see FIG. 1) faces a bottom wall portion 136 of the fitting groove 132.

In a state in which the second connector 14 is fitted into the first connector 12, the lower end portion of the shield shell 120 and the extending wall portion 114 (see FIG. 5) of the first connector 12 are inserted into the gap 50 of the first connector 12, and the fitted portion 92 of the second connector 14 is fitted into the fitting portion 30 of the first connector 12. As illustrated in FIG. 4, in a state in which the fitted portion 92 of the second connector 14 is fitted into the fitting portion 30 of the first connector 12, a top wall portion 138 of the fitted portion 92 faces the bottom wall 32 of the fitting portion 30.

(Second Terminal)

The plurality of second terminals 64 are formed by punching a conductive metal plate into a predetermined shape, and constitute a pair of front and rear terminal rows 140 and 142. The front and rear terminal rows 140 and 142 each have a configuration in which the plurality of second terminals 64 are arranged at equal intervals in the left-right direction, in a direction in which a thickness direction of the second terminal 64 is the front-rear direction (see FIG. 5). The plurality of second terminals 64 of the front terminal row 140 and the plurality of second terminals 64 of the rear terminal row 142 are formed in the same shape, and are disposed to face each other in the front-rear direction. The plurality of second terminals 64 of the front terminal row 140 are provided on a front side wall portion 104 of the fitted portion 92 (see FIG. 1), and the plurality of second terminals 64 of the rear terminal row 142 are provided on a rear side wall portion 104 (see FIG. 1) of the fitted portion 92.

As illustrated in FIG. 4, each second terminal 64 includes an exposed portion 144, a second holding portion 146, and a second connection portion 148. The exposed portion 144 is held by the fitted portion 92 and is positioned between the fitted portion 92 and the shield shell 120, the second holding portion 146 extends upward from the exposed portion 144 and is partially inserted into the second terminal insertion hole 102 and the groove portion 108, and the second connection portion 148 extends from an end portion of the second holding portion 146 outward in the front-rear direction, is disposed in the groove portion 112 of the second housing 90, and is fixed to a circuit board, the end portion of the second holding portion 146 being opposite to an end portion from which the exposed portion 144 extends.

Figure 5:
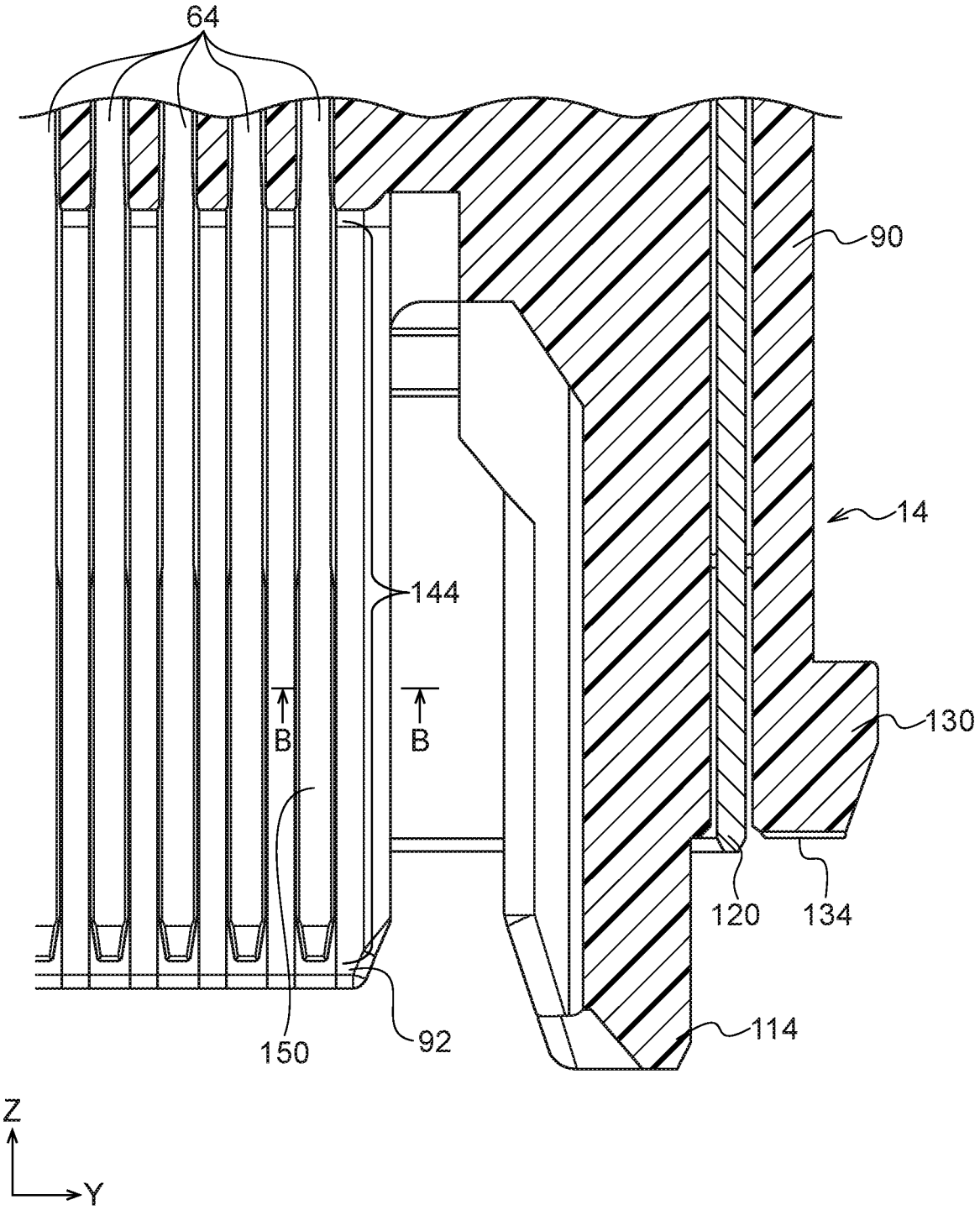
FIG. 5 is a partial cross-sectional view illustrating a fitted portion of the second connector according to an embodiment.

As illustrated in FIG. 5, the exposed portion 144 is a part of a lower end side of the second terminal 64 that is exposed to the outside, and includes a wide-width portion 150 (see FIG. 8), a general portion 152, and an inclined portion 154. The wide-width portion 150 is in electrical contact with the first terminal 26 provided in the first connector 12, the general portion 152 extends upward from the wide-width portion 150, and the inclined portion 154 is provided between the wide-width portion 150 and the general portion 152.

Figure 8:
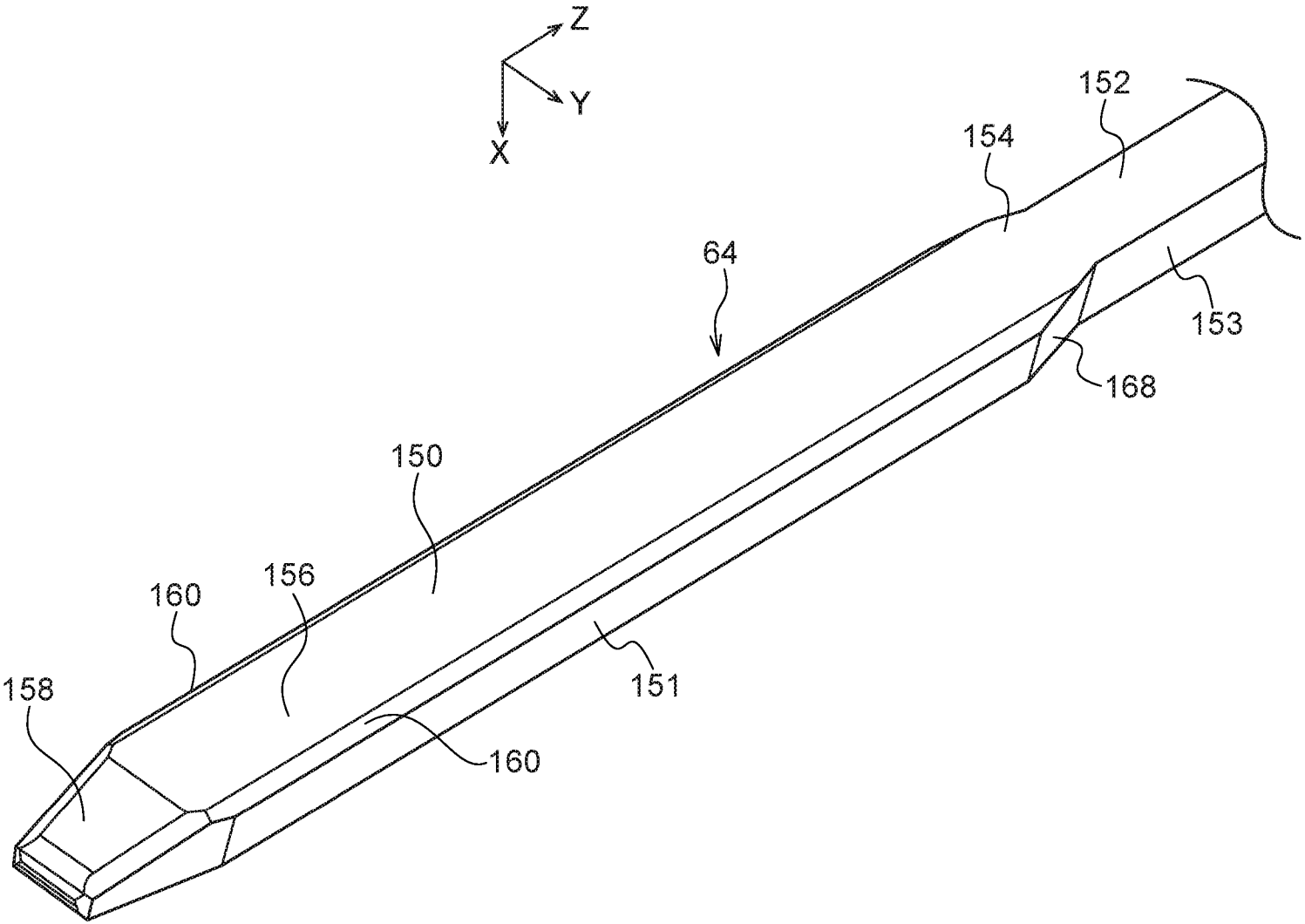
FIG. 8 is a perspective view of the second terminal according to an embodiment.
Figure 9:
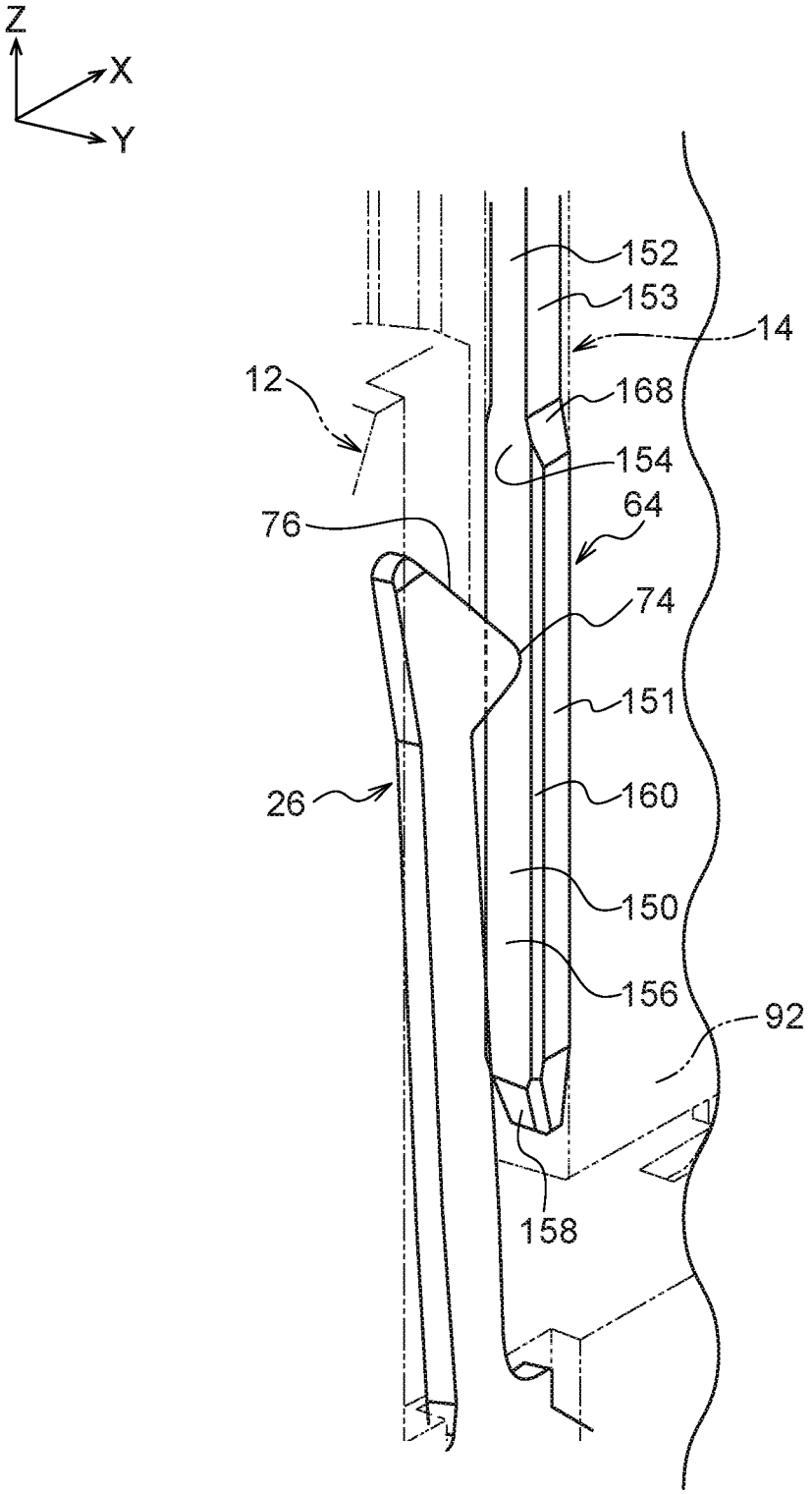
FIG. 9 is a perspective view illustrating a contact state between a first terminal and the second terminal at the time of normal fitting of the connector according to an embodiment.

The wide-width portion 150 is provided at a distal end side of the fitted portion 92, and as illustrated in FIG. 8, the dimension of a contact surface 156 in a width direction is set to be larger than the dimension of the general portion 152 in a width direction, the contact surface 156 being perpendicular to the thickness direction of the second terminal 64 and coming into contact with the first terminal contact portion 74 (see FIG. 9). A guide portion 158 is formed at a distal end of the wide-width portion 150, the guide portion 158 having an inclined surface of which dimensions in a width direction and in a plate thickness direction are each increased upward.

Tapered portions 160 are formed at a pair of end portions of the contact surface 156 of the wide-width portion 150 in the left-right direction, respectively. As illustrated in FIG. 6, the tapered portion 160 is formed so as to face a chamfered portion 162 in a cross-section shape of the groove portion 96.

Figure 3:
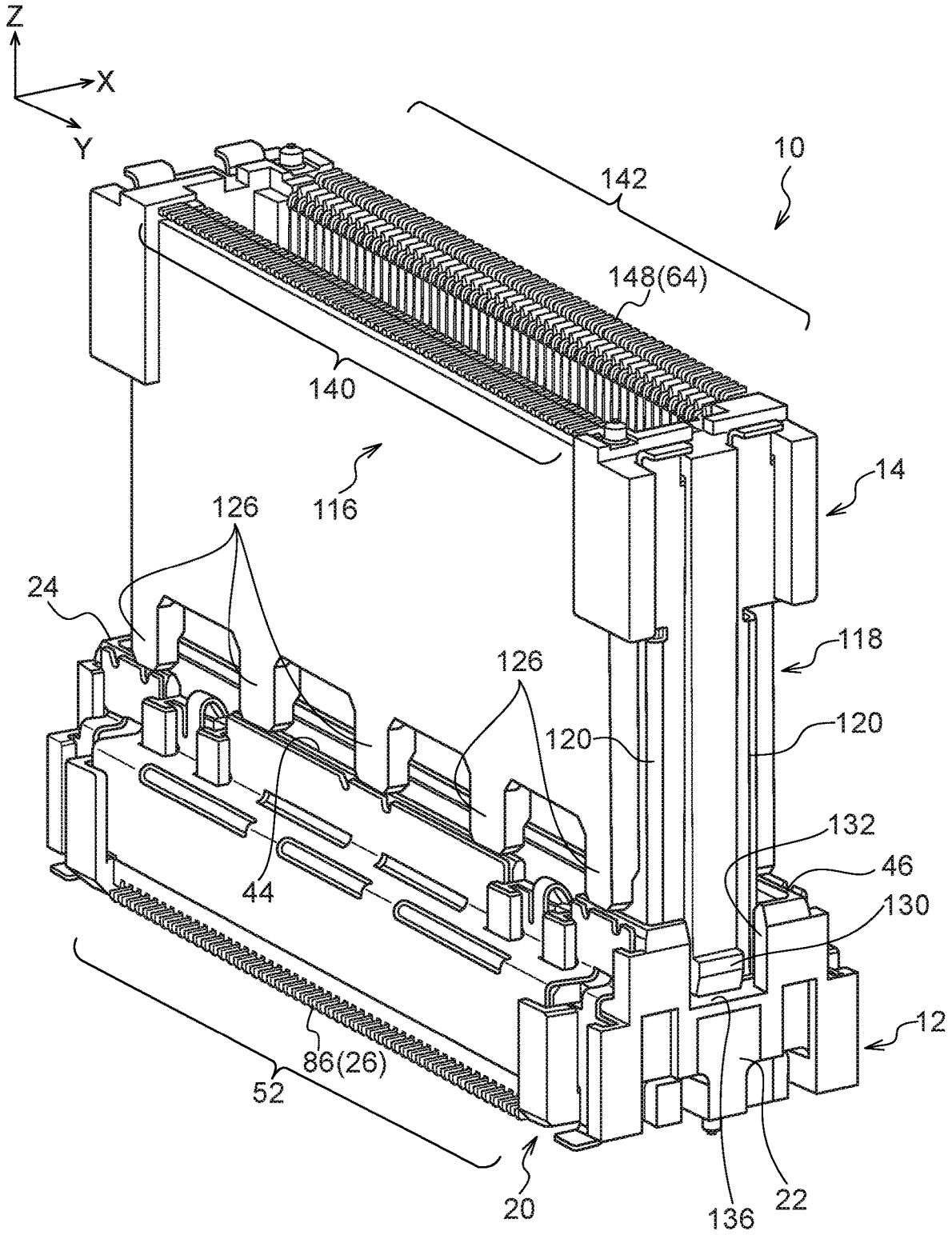
FIG. 3 is a perspective view illustrating a fitted state in which the second connector according to an embodiment is completely fitted into a first connector.
Figure 10:
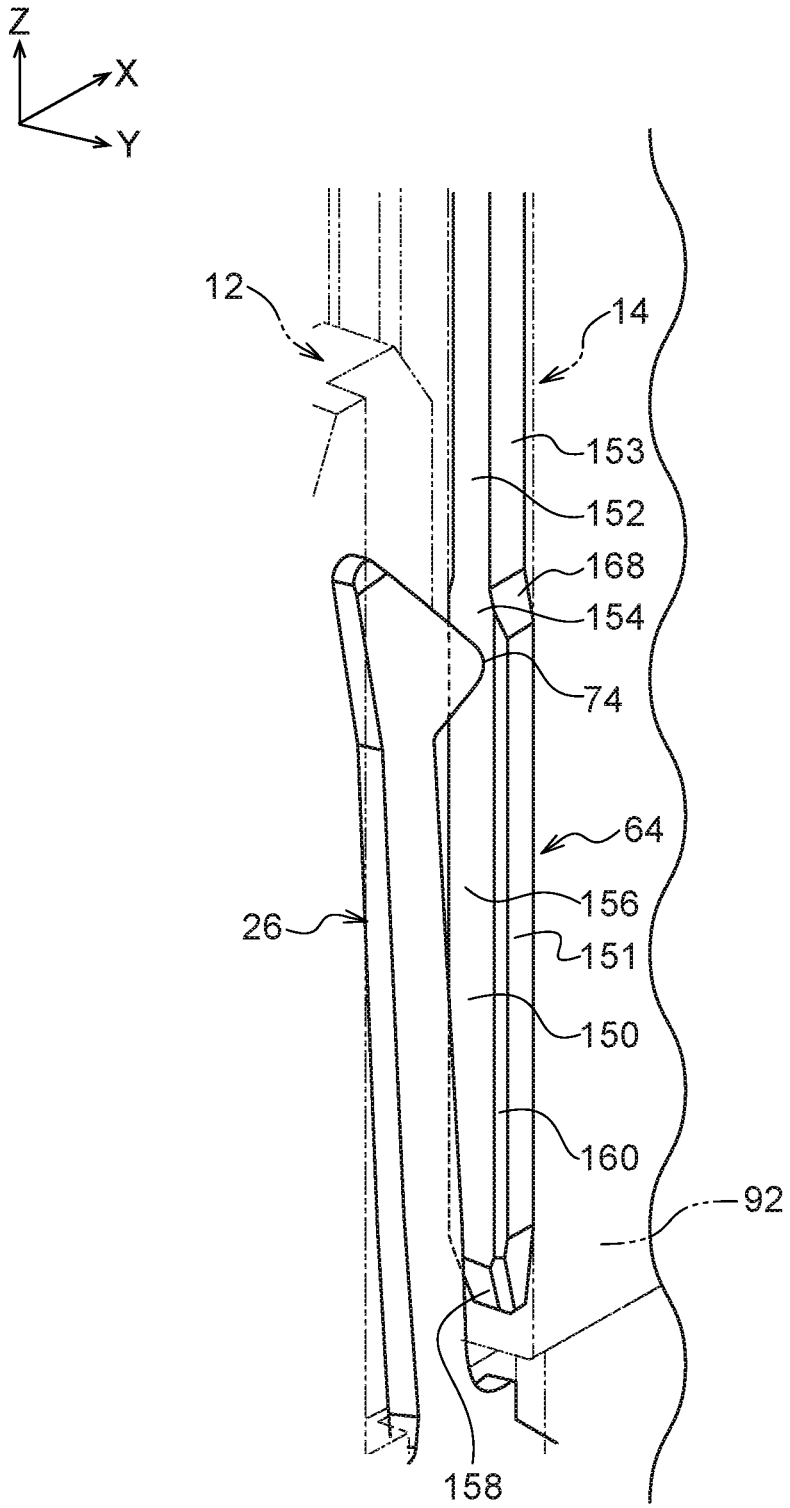
FIG. 10 is a perspective view illustrating a contact state between the first terminal and the second terminal in a case in which the second connector according to an embodiment is completely fitted into the first connector.

As illustrated in FIG. 10, the wide-width portion 150 is configured such that the first terminal contact portion 74 of the first terminal 26 comes into contact with the contact surface 156 of the wide-width portion 150 in a state in which the second connector 14 cannot be fitted (inserted) into the first connector 12 more. That is, in a normal fitting state of the first connector 12 and the second connector 14 illustrated in FIG. 2, the first terminal contact portion 74 of the first terminal 26 comes into contact with the wide-width portion 150 of the second terminal 64 as illustrated in FIG. 9. In this state, in a case where the second connector 14 is fitted deeper into the first connector 12, the bottom wall portion 134 (see FIG. 1) of the abutting portion 130 of the second connector 14 abuts on the bottom wall portion 136 of the fitting groove 132 of the first connector 12 as illustrated in FIG. 3. Similarly, bottom wall portions 128 (see FIG. 1) of the abutting portions 126 of the second connector 14 abut on the upper end portions of the side wall portions 44 and 46 of the second connector 14, respectively. As a result, the second connector 14 cannot be fitted into the first connector 12 more. In this state, as illustrated in FIG. 10, the second terminal 64 moves downward, but a range of the wide-width portion 150 in the top-bottom direction is set so that the first terminal contact portion 74 of the first terminal 26 does not come into contact with the inclined portion 154 or the general portion 152 of the second terminal 64.

Figure 7:
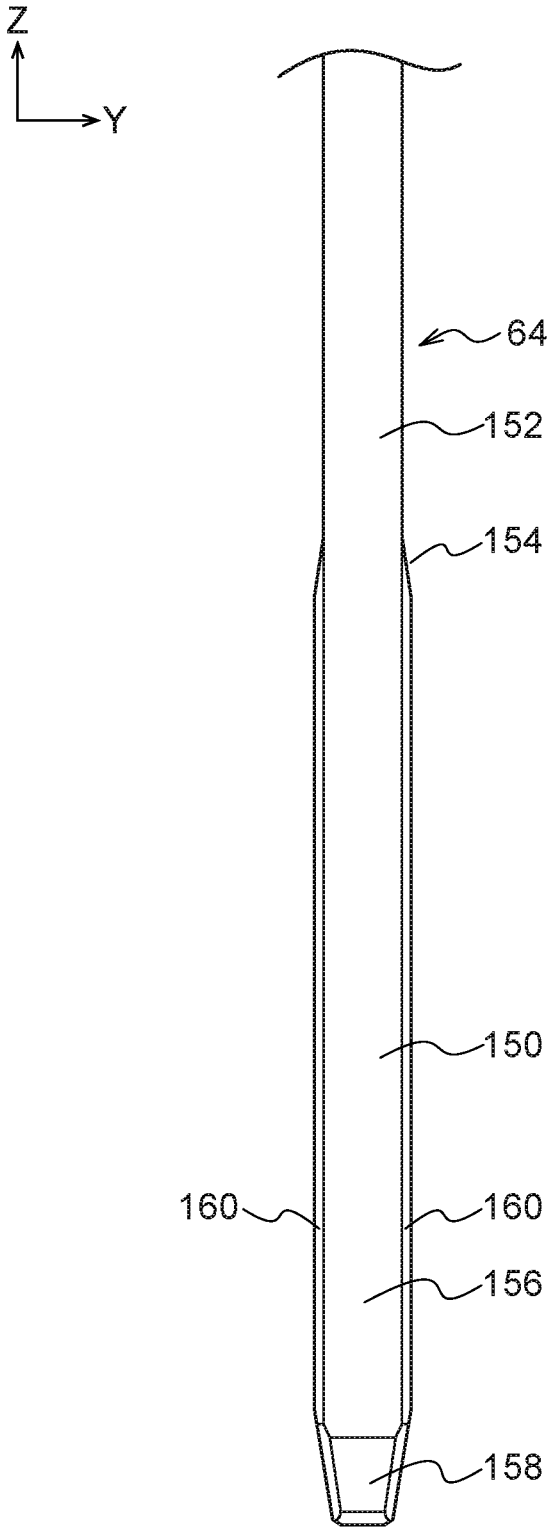
FIG. 7 is a front view of a second terminal according to an embodiment.

As illustrated in FIG. 7, the dimension of the general portion 152 in the width direction is set to be smaller than that of the wide-width portion 150, and the dimension in the width direction is substantially constant. As illustrated in FIG. 8, in the inclined portion 154, a pair of left and right inclined surfaces 168 that are connected to side wall portions 153 of the general portion 152 as directing upward from upper end portions of side wall portions 151 of the wide-width portion 150, is provided. An inclination angle of the inclined surface 168 with respect to the top-bottom direction is set to an acute angle so as to smoothly connect the wide-width portion 150 and the general portion 152.

(Actions and Effects)

Next, actions and effects of the embodiment will be described.

In the embodiment, the wide-width portion 150 is formed in the second terminal 64 provided on the fitted portion 92 of the second connector 14. In the second terminal 64, the wide-width portion 150 is provided at the distal end side of the fitted portion 92 of the second connector 14, and the dimension of the wide-width portion 150 in the width direction is set to be larger than that of the general portion 152 in the width direction. Further, as illustrated in FIG. 10, the first terminal 26 comes into contact with the wide-width portion 150 of the second terminal 64 from a state in which the fitted portion 92 of the second connector 14 is started to be fitted into the fitting portion 30 of the first connector 12 to a state in which the fitted portion 92 cannot be fitted more (see FIG. 3). Therefore, since the first terminal 26 does not come into contact with the general portion 152 of the second terminal 64, there is no need to consider a contact area between the general portion 152 and the first terminal 26 or the like for the dimension of the general portion 152 in the width direction. For this reason, the dimension of the general portion 152 in the width direction can be reduced in order to increase the impedance.

Further, since the first terminal 26 comes into contact with the wide-width portion 150 of which the dimension in the width direction is larger than that of the general portion 152 in the second terminal 64 in a state in which the fitted portion 92 of the second connector 14 cannot be fitted into the fitting portion 30 of the first connector 12 more, it becomes easy to secure a contact area. That is, an electrical conduction state can be ensured. As a result, reliability in connection with a mating terminal is excellent, and the impedance of the terminals can be increased.

Furthermore, as illustrated in FIG. 9, the inclined guide portion 76 is provided in the first terminal 26. The inclined guide portion 76 can serve as a so-called guide to stably bring the first terminal contact portion 74 into contact with the second terminal 64 when the second connector 14 is fitted into the first connector 12 including the first terminal 26. Since the inclined guide portion 76 is inclined in a direction away from the second terminal 64 on progression toward the second connector 14 from the first terminal contact portion 74 in the fitting direction Z, the inclined guide portion 76 does not come into contact with the second terminal 64 in a state in which the first terminal contact portion 74 is in contact with the second terminal 64. In other words, in a state in which the fitted portion 92 of the second connector 14 cannot be fitted into the fitting portion 30 of the first connector 12 more, a portion of the second terminal 64 that overlaps with at least a part of the inclined guide portion 76 of the first terminal 26 when viewed in a direction perpendicular to the contact surface 156 of the second terminal 64 with which the first terminal 26 comes into contact is a dead space with which the first terminal 26 does not come into contact. That is, since the general portion 152 is disposed in the dead space, the impedance can be increased while effectively utilizing spaces.

The inclined portion 154 is provided between the wide-width portion 150 and the general portion 152 in the second terminal 64, and the inclined portion 154 smoothly connects the wide-width portion 150 and the general portion 152 to each other when viewed in a direction perpendicular to the contact surface 156 of the second terminal 64 with which the first terminal 26 comes into contact. Therefore, it is possible to suppress the reflection of an electric signal at a boundary between the wide-width portion 150 and the general portion 152.

Further, since the dimension of the general portion 152 in the width direction is substantially constant, it is possible to suppress the reflection of the electric signal as compared with a configuration in which a notch or the like is partially provided to increase the impedance.

Furthermore, since the second terminal 64 is formed by using a plate of which a thickness direction is a direction perpendicular to the contact surface 156 of the second terminal 64 with which the first terminal 26 comes into contact, the wide-width portion 150 and the general portion 152 are configured such that dimensions of the plate in the width direction are different from each other. That is, since the plate is processed in the width direction to form the wide-width portion 150 and the general portion 152, the dimensional accuracy can be improved as compared with a case in which the plate is processed in the thickness direction. Therefore, variation in shape of the second terminal 64 can be reduced.

(Modified Example)

Figure 11:
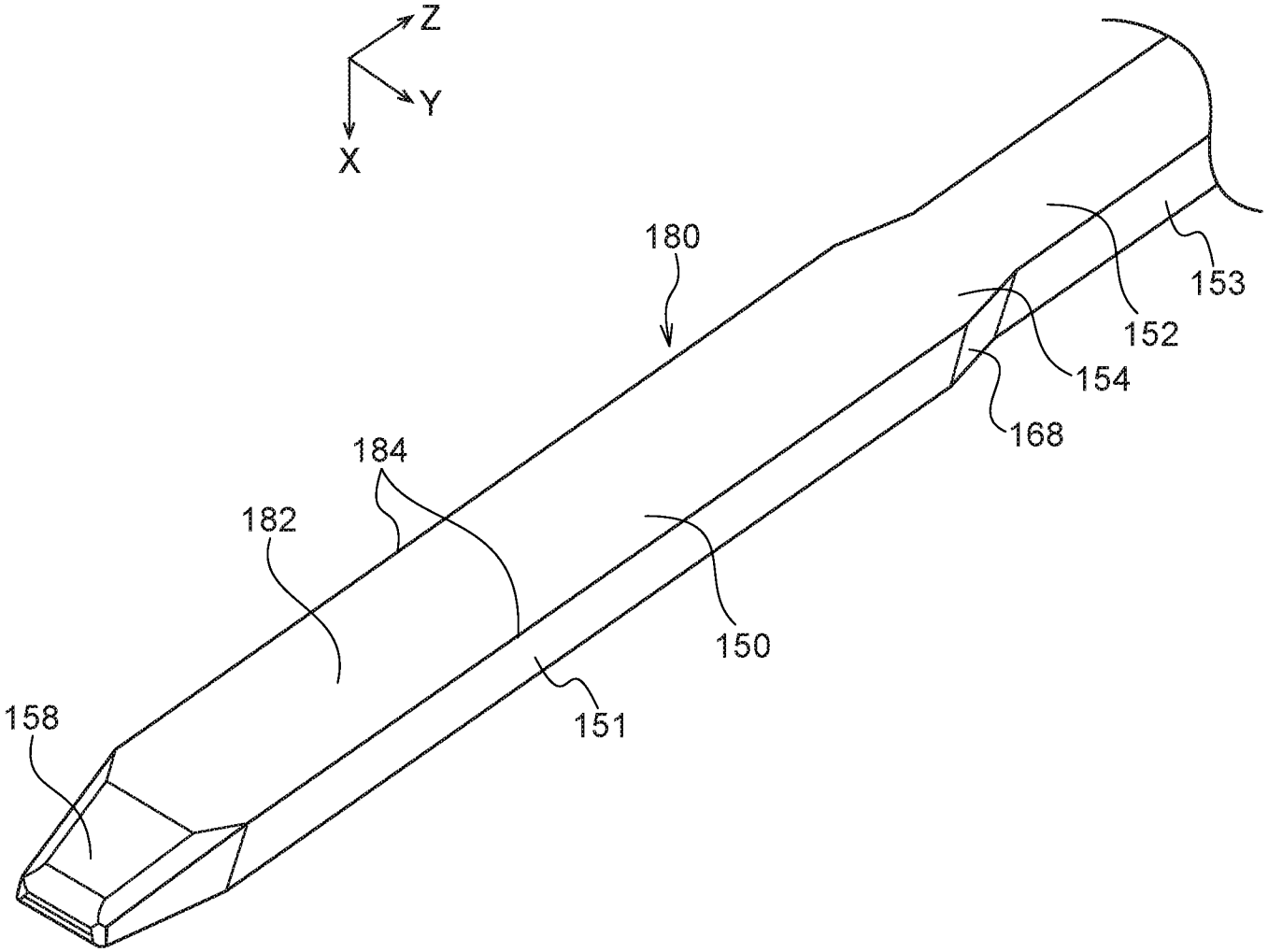
FIG. 11 is a perspective view of a second terminal according to a modified example.

As illustrated in FIG. 8, the tapered portions 160 are provided at the pair of end portions of the contact surface 156 of the second terminal 64 in the left-right direction, but the disclosure is not limited thereto. The tapered portions 160 need not be provided at a pair of end portions of a contact surface 182 of a second terminal 180 in the left-right direction as illustrated in FIG. 11. As a result, as illustrated in FIG. 12, since corners 184 of the pair of end portions of the contact surface 182 of the second terminal 180 in the left-right direction interfere with the chamfered portions 162 of the groove portion 96, the second terminal 180 is energized inward in the front-rear direction, such that the second terminal 180 can be appropriately disposed in the groove portion 96 at the time of assembly. Therefore, the first terminal 26 and the second terminal 180 can be stably brought into contact with each other at the time of fitting into the first connector 12.

Although the embodiment of the disclosure has been described above, the disclosure is not limited thereto, and it is a matter of course that the disclosure may be variously modified and implemented without departing from the gist of the disclosure.

What is claimed is:

1. A connector, comprising:

a first connector including a fitting portion and a plurality of first terminals provided in the fitting portion, each of the first terminals including a first contacting portion being elastically deformable; and a second connector including a fitted portion configured to be fitted into the fitting portion of the first connector, and a plurality of second terminals that is provided on the fitted portion, extends along a fitting direction, and each of the plurality of second terminals comes into electrical contact with the first contacting portion of each of the first terminal in a case in which the fitted portion is fitted into the fitting portion of the first connector, wherein:

in each of the second terminals, a wide-width portion, having a dimension in one direction that is larger than a dimension of a general portion, is formed at a distal end side of the fitted portion, the one direction being an in-plane direction of a surface of the second terminal with which the first terminal comes into contact and being orthogonal to the fitting direction of the fitted portion, wherein the general portion is located at a proximal end side and the wide width portion is located at the distal end side whereby the second terminal is wider at the distal end side than at the proximal end side such that a width of the general portion is reduced in order to increase impedance of the second terminal, and each of the first terminals comes into contact with the wide-width portions of the second terminals with the first contacting portion being elastically deformable from a state in which the fitted portion of the second connector starts to be fitted into the fitting portion of the first connector to a state in which the fitted portion is not able to be fitted any further.

2. The connector according to claim 1, wherein:

in the first terminal, an inclined guide portion is provided, which is inclined in a direction away from the second terminal on progression toward the second connector from a first terminal contact portion in the fitting direction, the first terminal contact portion being a portion with which the second terminal comes into contact, and in a state in which the fitted portion of the second connector is not able to be fitted into the fitting portion of the first connector any further, at least a portion of the inclined guide portion is disposed at a position corresponding to the general portion of the second terminal when viewed in a direction perpendicular to the surface of the second terminal with which the first terminal comes into contact.

3. The connector according to claim 1, wherein an inclined portion, which smoothly connects the wide-width portion and the general portion to each other when viewed in the direction perpendicular to the surface of the second terminal with which the first terminal comes into contact, is provided between the wide-width portion and the general portion in the second terminal.

4. The connector according to claim 1, wherein the general portion of the second terminal has a substantially constant dimension in the one direction that is the in-plane direction of the surface of the second terminal with which the first terminal comes into contact and that is orthogonal to the fitting direction of the fitted portion.

5. The connector according to claim 1, wherein the second terminal is formed by using a plate having a thickness direction in a direction perpendicular to the surface of the second terminal with which the first terminal comes into contact.

* * * * *